US005395590A

United States Patent [19]

Swaniger et al.

[11] Patent Number: 5,395,590

[45] Date of Patent: Mar. 7, 1995

[54] VALVED CONTAINER LID

[76] Inventors: James R. Swaniger, 503 Orange Blossom, Irvine, Calif. 92720; Edward E. Elson, 4356 Claytor Cir., Anaheim, Calif. 92806

[21] Appl. No.: 940,628

[22] Filed: Sep. 4, 1992

[51] Int. Cl.[6] ..... B01L 3/00; B01L 11/00; B65D 47/00; B65D 47/36

[52] U.S. Cl. ..... 422/103; 215/307; 215/317; 220/209; 222/490; 422/102

[58] Field of Search ..... 422/102, 103; 436/180; 220/209, 203, 367; 222/490, 494; 215/227, 247, 260, 307, 317; 604/415; 251/149.8, 342, 151

[56] References Cited

U.S. PATENT DOCUMENTS

| | | | |
|---|---|---|---|
| 584,091 | 6/1897 | Leidich | 137/849 |
| 1,865,764 | 9/1930 | Keenan | 220/203 X |
| 2,098,799 | 11/1937 | Wilson | 222/490 |
| 2,213,465 | 9/1940 | Gay | 15/257.075 |
| 2,263,890 | 11/1941 | Salvesen | 215/307 |
| 2,436,291 | 2/1948 | Daniel | 15/257.05 |
| 2,446,085 | 7/1948 | Gronemeyer | 222/446 |
| 2,597,410 | 5/1952 | Tronson | 222/490 |
| 2,773,521 | 12/1956 | Persson | 141/5 |
| 2,957,503 | 10/1960 | Stifter | 141/321 |
| 3,105,613 | 10/1963 | Barton et al. | 604/415 |
| 3,182,694 | 5/1965 | Raimo | 141/321 |
| 3,232,499 | 2/1966 | Esposito | 222/499 |
| 3,478,922 | 11/1969 | Mole | 220/86.2 |
| 3,557,986 | 1/1971 | Poole | 215/260 X |
| 3,684,119 | 8/1972 | Burroughs | 215/260 X |
| 3,823,840 | 7/1974 | Zackheim | 215/247 |
| 3,941,171 | 3/1976 | Ogle | 141/309 |
| 4,165,816 | 8/1979 | Tupper | 220/303 X |
| 4,197,735 | 4/1980 | Munzer et al. | 422/103 X |
| 4,362,698 | 12/1982 | Boosalis et al. | 422/102 |
| 4,427,110 | 1/1984 | Shaw, Jr. | 206/205 |
| 4,475,914 | 10/1984 | Portnoff | 141/3 X |
| 4,515,752 | 5/1985 | Miramanoa | 422/102 X |
| 4,573,506 | 3/1986 | Paoletti | 604/415 |
| 4,998,633 | 3/1991 | Schneider | 220/367 X |
| 5,012,061 | 4/1991 | Lesser | 220/367 X |
| 5,071,017 | 12/1991 | Stull | 220/490 X |
| 5,092,840 | 3/1992 | Healy | 604/83 |
| 5,111,946 | 5/1992 | Glanz | 215/247 |
| 5,169,602 | 12/1992 | Pang et al. | 422/103 |
| 5,202,093 | 4/1993 | Cloyd | 422/102 |

FOREIGN PATENT DOCUMENTS

| | | |
|---|---|---|
| 0138681 | 4/1985 | European Pat. Off. . |
| 2588835 | 4/1987 | France . |

*Primary Examiner*—Robert J. Warden
*Assistant Examiner*—Robert Carpenter

[57] ABSTRACT

A cover for placement on a container to allow transfer of fluid from the container to a second container comprising a lid having a skirt at its outer edge for liquid-tight attachment to the liquid filled container, a valved region centrally located on the lid, a connector located within the valve portion, and normally closed ports located within the connector. After the second container is attached to the connector the liquid-filled container with the lid attached is inverted and the lid is flexed causing the port to open and the fluid to flow from the first liquid filled container into the second container.

5 Claims, 5 Drawing Sheets

VALVED CONTAINER LID

BACKGROUND

The present invention relates to a valved lid for attachment to a surface of a liquid-holding container. The lid allows a filled container to be held and stored without fear of the contents being contaminated or spilled, thus contaminating the surrounding area or a person handling the container or transferring its contents. Built into the lid is a valved connector which allows transfer of the liquid contents into a second container without loss or spillage of any of the container contents.

More particularly, the invention relates to a valved lid for attachment to a cup or jar used to collect urine samples. The valved lid includes structure on its external surface sized and shaped to connect with a test tube or centrifuge tube. In performing a urinalysis, urine is transferred from a collection container to a second container, such as a test tube, into which test strips or indicator chemicals are added to diagnose for chemical imbalance, infections, venereal disease, AIDS, HIV, tumor markers, or other indicators of health problems. Additionally, a complete urinalysis usually includes transfer of urine to a centrifuge tube so that sediment or cells in the urine can be separated from the urine and studied under a microscope. Some of these tubes have a circular open end while others can have various different shaped openings. For example, specially designed centrifuge tubes, which also have a microscope slide portion, are shown in U.S. Pat. No. 4,066,414, 4,865,812 and 5,030,421. U.S. Pat. No. 5,030,421 to Muller shows a tube with a unique flattened cylindrical cross section and lip on one end and a microscope slide portion on the other end.

The usual procedure is to pour the urine from the collection container into the test tube or centrifuge tube or to transfer the urine using a syringe or pipet, procedures which require removal of the lid or piercing the lid with the transfer instrument. However, because of serious concerns about contaminating the laboratory environment, transmitting infection to the medical technician handling the urine, or cross contamination between samples, these procedures are no longer acceptable. Additionally, disposal or cleaning of the syringe, pipet or other laboratory transfer instruments is costly, time consuming and subject to various governmental controls.

Thus, there is a need for a system which will allow transfer fluids from a first container to a second container without use of additional instruments or utensil and which eliminates the possibility of fluid leakage and contamination of the surroundings or the laboratory technician.

SUMMARY

These needs are met by the present invention which comprises a flexible lid sized to fit on a first container in a leak tight manner, the lid having a central portion which includes structure to receive a second container in a leak tight manner, the central portion including normally closed drainage ports which allow transfer of fluid from the first container to the second container by flexing at least the central portion of the lid, the liquid transfer being accomplished without piercing the lid with a liquid transfer device.

More particularly, the invention comprises a flexible lid for attachment to a urine collection container, the lid having a raised hollow structure centrally located on its upper outer surface, the raised structure sized and shaped to fit into and/or around the open end of a specimen tube used for analytical purposes. Located within the hollow raised structure is a normally closed valve which opens, and thus allows transfer of fluid from the urine container to the collection tube, by inverting the container and lid combination and pressing the flexible lid toward the fluid within the collection container. In a particular embodiment, the valve consists of one or more slits or holes, preferably tapered.

BRIEF DESCRIPTION OF THE DRAWINGS

These and other features, aspects and advantages of the present invention will become better understood with reference to the following description, appended claims, and accompanying drawings, where:

DESCRIPTION

The figures are directed to several different version of valved lids embodying features of the invention. Like components are designated by the same identifying number.

FIGS. 1 through 5 and 18 and 19 show a first version of a container lid 10 embodying features of the present invention.

Figure 1:
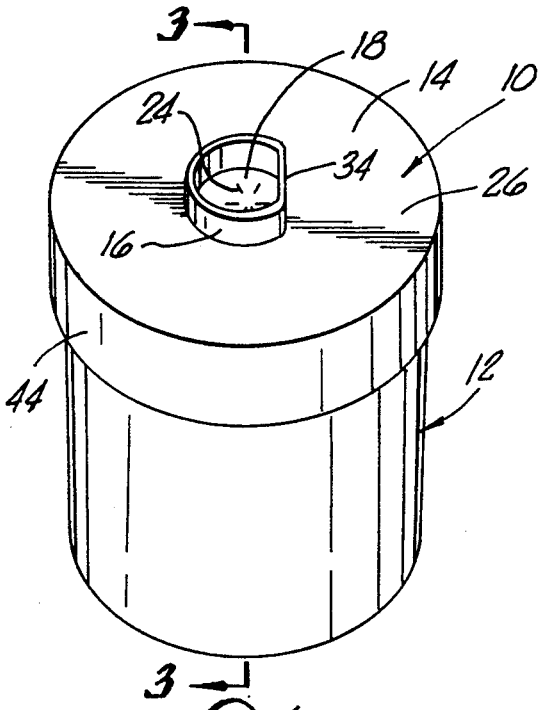
FIG. 1 is a perspective side view of a container having attached thereto a lid incorporating features of the invention.

FIG. 1 shows the lid 10 placed over and sealing the open end of a container 12. The lid 10 has a depending skirt 44 at its outer edge for liquid tight fitting of the lid 10 to the container 12 and a valve portion 14, which includes a connector 16, for attaching a specimen tube 20 to the lid 10 and draining fluid from the container 12 into the specimen tube 20. A valve portion 14 is placed substantially in the center of the lid 10. The valved portion 14 includes a connector 16 and a drainage port 18. The connector 16 is sized and shaped so that a specimen tube 20 can be fitted in a liquid tight manner onto the connector 16. In this manner, the lidded container 12 can be inverted and a portion of the liquid in the container 12 transferred to the specimen tube 20 without fluid 22 leaking to the surroundings.

Figure 2:
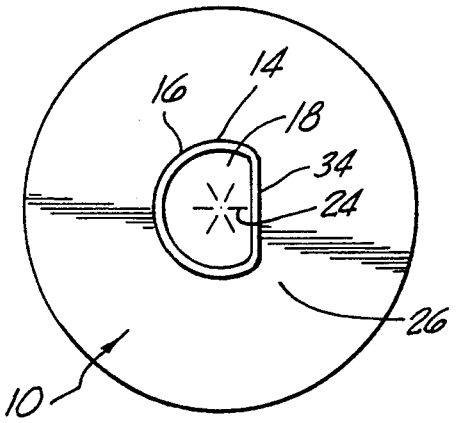
FIG. 2 is a top view of the lid of FIG. 1.
Figure 3:
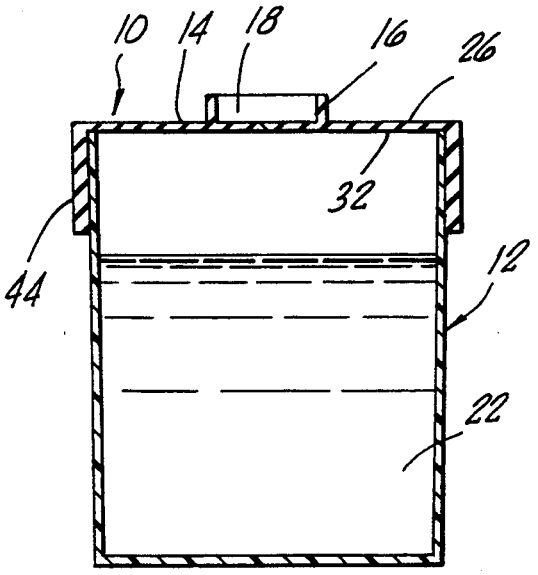
FIG. 3 is a cross sectional view of the container and lid combination of FIG. 1 taken along line 3—3 of FIG. 1.
Figure 4:
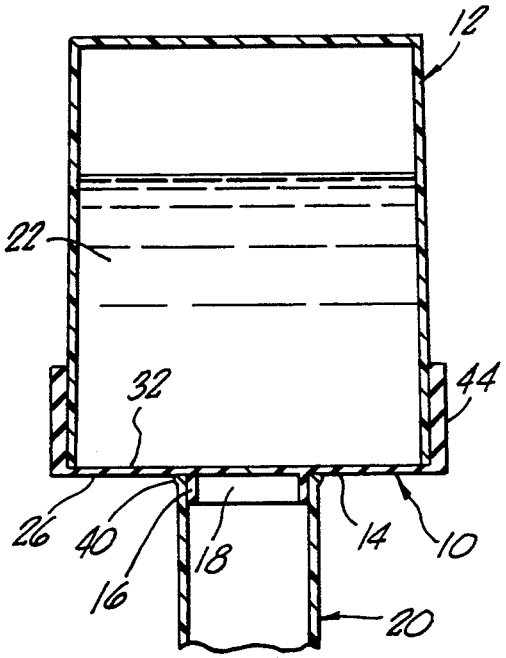
FIG. 4 is a cross sectional view of the container and lid combination of FIG. 1 with a specimen tube attached to the lid and the combination inverted for transfer of fluid, the cross section taken along line 3—3 of FIG. 1.
Figure 5:
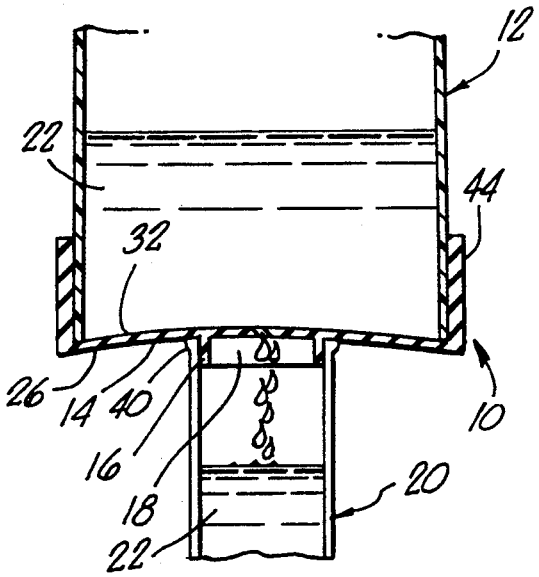
FIG. 5 is a cross sectional view of the container, lid and specimen tube combination of FIG. 4 during transfer of fluid, the cross section taken along line 3—3 of FIG. 1.
Figure 18:
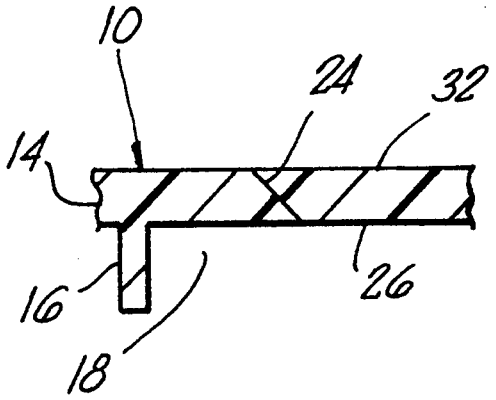
FIG. 18 is an enlarged cross sectional view of a portion of the lid of FIG. 2 showing a slit in its normally closed configuration.
Figure 19:
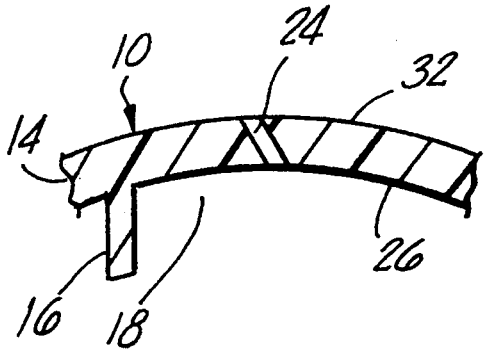
FIG. 19 is an enlarged cross sectional view of a portion of the lid of FIG. 2 showing a slit in its open configuration.

The drainage port 18 can include various different means to access the fluid in the container 12. FIGS. 2–5 illustrate the use of several slits 24 located within the drainage port 18, the slits 24 radiating, but spaced from, the center of the valve portion 14. The valve portion 14 has been demonstrated to function with four to twelve radial slits 24; FIG. 2 exhibits the use of six slits 24 with each slit 24 being at an angle of about 45° to the top surface 26 of the lid 10. FIGS. 1–4 and 18 show the valve with the slit 24 in its normally closed position. FIGS. 5 and 19 show the lid 10 flexed and the slit 24 opened for transfer of fluid.

Figure 6:
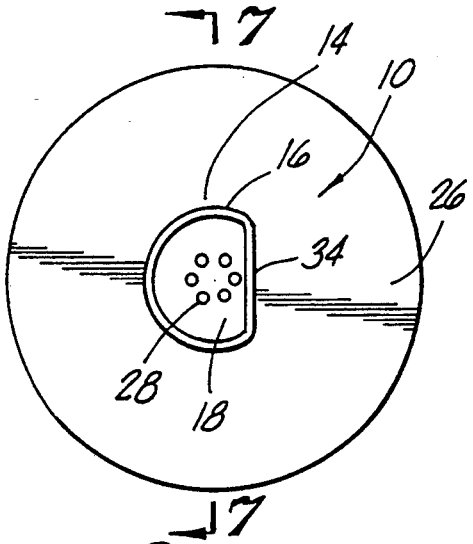
FIG. 6 is a top view of a second embodiment of the lid embodying features of the invention.
Figure 7:
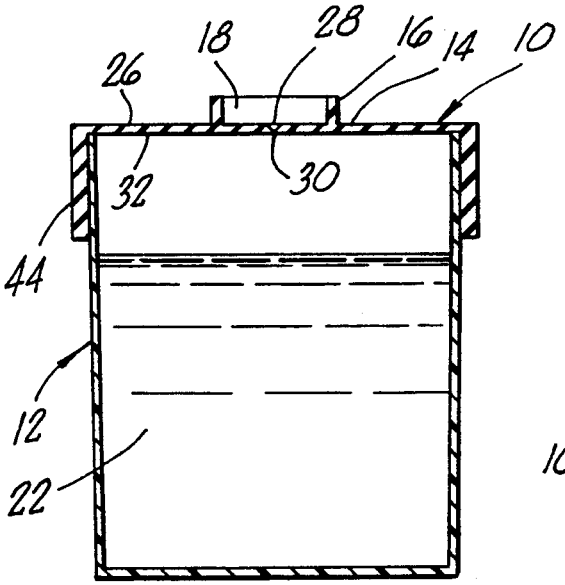
FIG. 7 is a cross sectional view of the lid and container combination taken along line 7—7 of FIG. 6.
Figure 8:
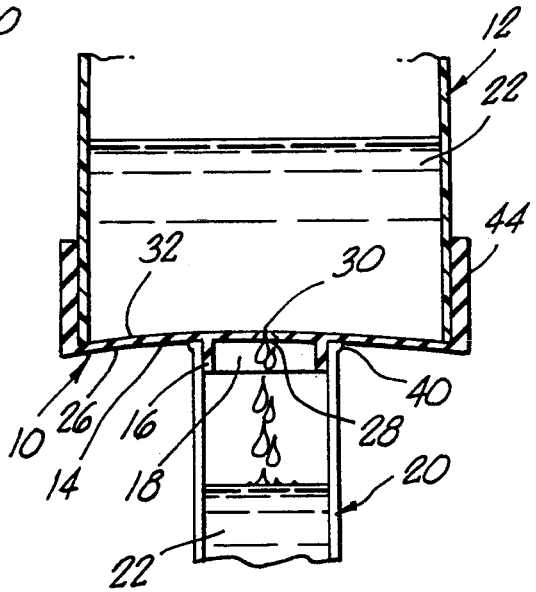
FIG. 8 is a cross sectional view of the container and lid combination of FIG. 7 with a specimen tube attached during transfer of fluid, the cross section taken along line 7—7 of FIG. 6.
Figure 20:
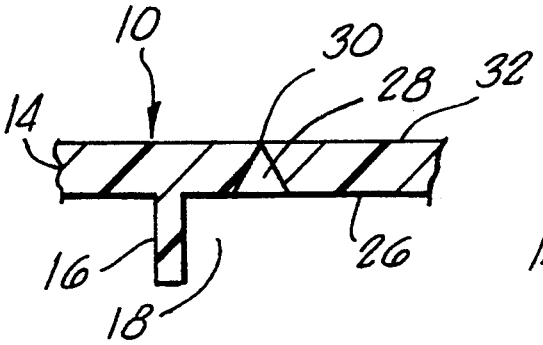
FIG. 20 is an enlarged cross sectional view of a portion of the lid of FIG. 6 showing a hole in its normally closed configuration.
Figure 21:
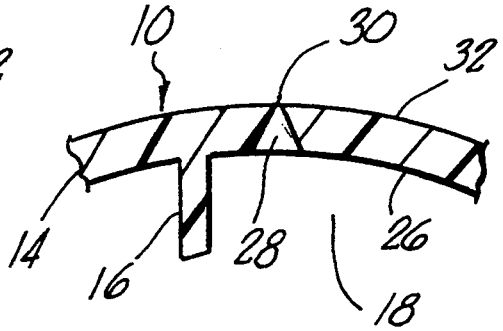
FIG. 21 is an enlarged cross sectional view of a portion of the lid of FIG. 6 showing a hole in its open configuration.

FIGS. 6–8 and 20–21 illustrate a second version of the valved lid 10 where the slits 24 are replaced by holes 28, preferably tapered, with the smaller end 30 of the tapered hole 28 being at the inner surface 32 of the lid 10. The taper of the hole 28 can converge at the inner surface 32 or be spaced from the inner surface 28, the remainder of the thickness of the lid 10 being pierced by a slit 24. FIGS. 6–7 and 20 show the valve when the hole 28 is in its normally closed position. FIGS. 8 and 21 show the lid 10 flexed and the hole 28 opened for transfer of fluid.

The two versions of the lid shown in FIGS. 1–8 have a connector 16 with a cylindrical cross section with one flattened surface 34. This particular configuration is specifically sized and shaped to fit the centrifuge tube shown in the Muller U.S. Pat. No. 5,030,421. However, various different shapes or sizes can be used to fit other specimen tubes, such as standard test tubes, which are used for urinalysis.

Figure 9:
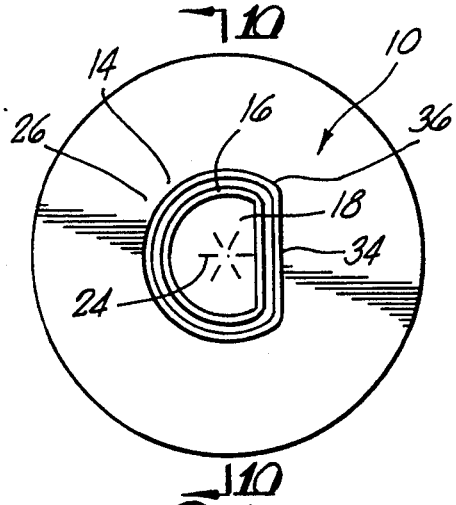
FIG. 9 is a top view of a third embodiment of the lid embodying features of the invention attached to a collection container.
Figure 10:
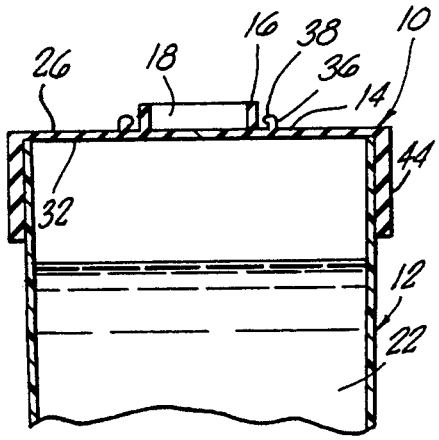
FIG. 10 is a cross sectional view of the lid of FIG. 9 taken along line 10—10 of FIG. 9.

FIGS. 9 and 10 show a third version of the lid 10 which has a rim 36 surrounding the connector 16. The rim 36 is sized and shaped to snugly enclose the outer surface of the specimen tube 20 once the tube 20 is placed on the connector 16. In the embodiment shown in the Figures the rim 36 also includes a bead 38 extending towards the connector 16. After attachment of a specimen tube the bead 38 encloses a ring 40 which exists on outer top end of most specimen tubes 20.

Figure 12:
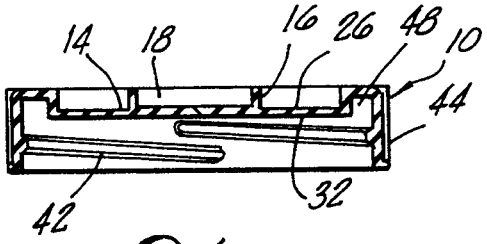
FIG. 12 is a cross sectional view of the lid of FIG. 11 taken along line 12—12 of FIG. 11.
Figure 11:
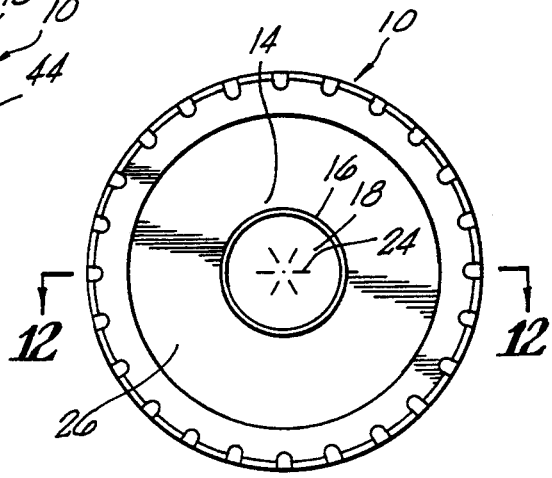
FIG. 11 is a top view of a fourth embodiment of the lid incorporating features of the invention.
Figure 13:
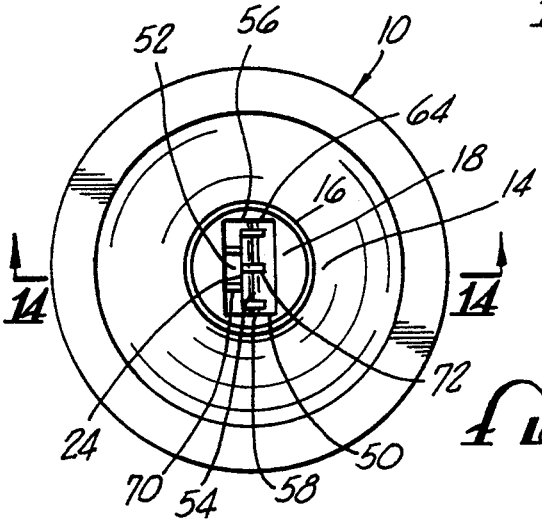
FIG. 13 is a top view of a still further embodiment of the lid incorporating a valve embodying features of the invention.
Figure 14:
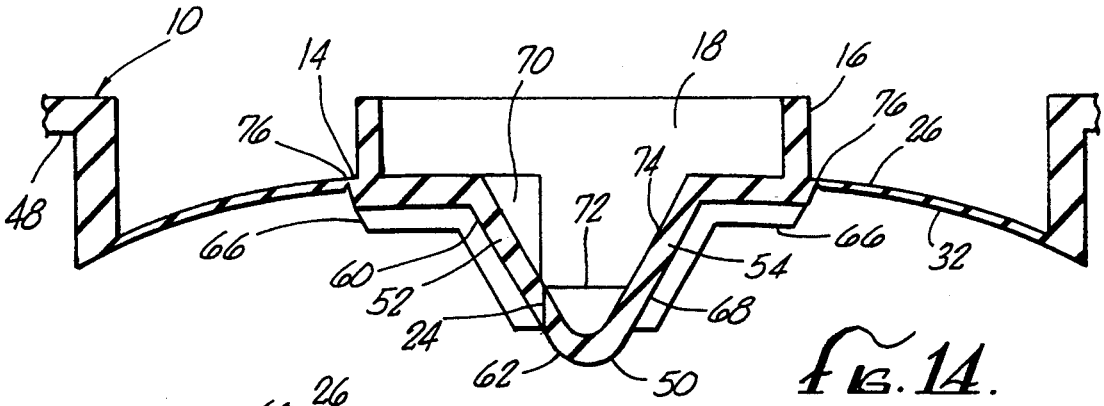
FIG. 14 is a cross sectional view of the central portion of the lid of FIG. 13 taken along line 14—14 of FIG. 13.

FIGS. 11 and 12 show a further variation of the lid of FIGS. 1–5. In the prior version the lid 10 is held on the container by a friction fit between a skirt 44 and the upper edge of the container 12. In the version of FIGS. 11 and 12, the lid 10 has screw threads 42 on the inner surface of a skirt 44 which depends from the top surface 26 of the lid 10. These threads intermesh with similar threads (not shown) on the upper outer edge of the container 12. The lid 10 of FIGS. 11 and 12 also has a channel 48 on the inner surface 32 of the lid 10 to further help prevent leakage of the fluid 22 when the assembled product is inverted as described below. A gasket (not shown) can be placed in the channel 48 or can be used in place of the channel 48 to also seal the lid to the container.

Figure 15:
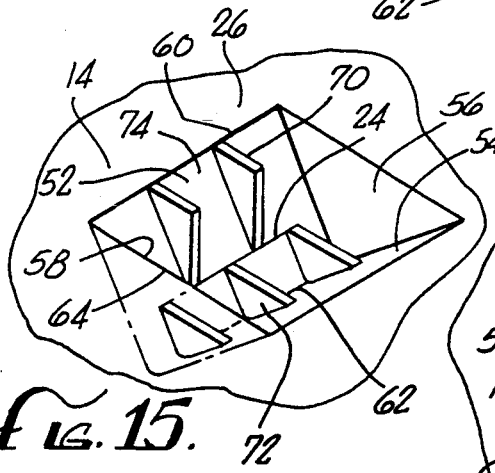
FIG. 15 is an enlarged top perspective view of the valve portion of the lid of FIG. 13.

FIGS. 13–17 show a still further version of the valved lid 10 which incorporates a variation of a duck bill shaped valve 50. The valve 50 is formed from first and second flexible depending walls 52, 54 and first and second side walls 56,58 connecting the depending walls 52,54. A first end 60 of each of the depending walls 52,54 is attached to the inner surface 32 of the lid 10, the flexible depending walls 52,54 being spaced from each other at the point of attachment to the lid 10 and being attached to each other at a second end 62 spaced from the first end 60 such that the depending walls 52,54 and the side walls 56,58 form a four sided pyramid with an open base 64, preferably rectangular, at the lid inner surface 32 and a closed top at the second end 62 which is spaced from and below the inner surface 32. At least one slit 24 is located in the first depending wall 52 or at the juncture of the walls (the second end) 62. The sides of the slit 24 are in intimate contact, in the same manner as shown in FIG. 18, so that fluid 22 will not leak through the slit 24 unless forcible opened. The slit 24 is preferably located in the first depending wall 52 rather than at the juncture of the walls 60 because a slit 24 located at the juncture 60 has a greater tendency to leak. To further assure that the slit 24 does not leak, the walls 52,54 of the valve 50 can be reinforced and stiffened by adding ribs to the outer surface of the wall and/or the inner surface of the wall. In the embodiment shown in FIGS. 13–17 rectangular ribs 66 are attached to a portion of the outer wall 68 of the valve 50 as well as the inner surface 32 of the lid 10 and two sets of triangular ribs 70, 72 are attached to the inner surface 74 of the duck bill valve 50. The two sets of triangular ribs are composed of an upper set of triangular ribs 70 with one side of the triangular ribs 70 attached to the upper portion of the inner surface 74 of the first depending wall 52 and a lower set of triangular ribs 72 with a first side of the triangular rib 72 being attached to the lower portion of the inner surface 74 of the first depending wall 52 and a second side being attached to the inner surface 74 of the second depending wall 54. The slit 24 is located in the first depending wall between the upper ribs 70 and the lower ribs 72 as best shown in FIG. 15.

Figure 16:
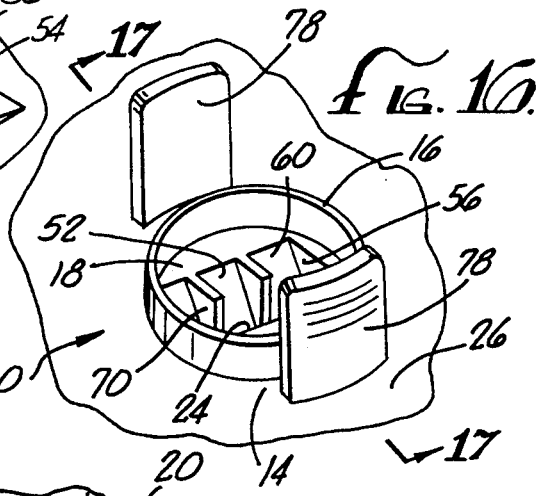
FIG. 16 is an enlarged top perspective view of the valve portion of a variant of the lid of FIG. 13, the variant having finger tabs for opening the slit valve.
Figure 17:
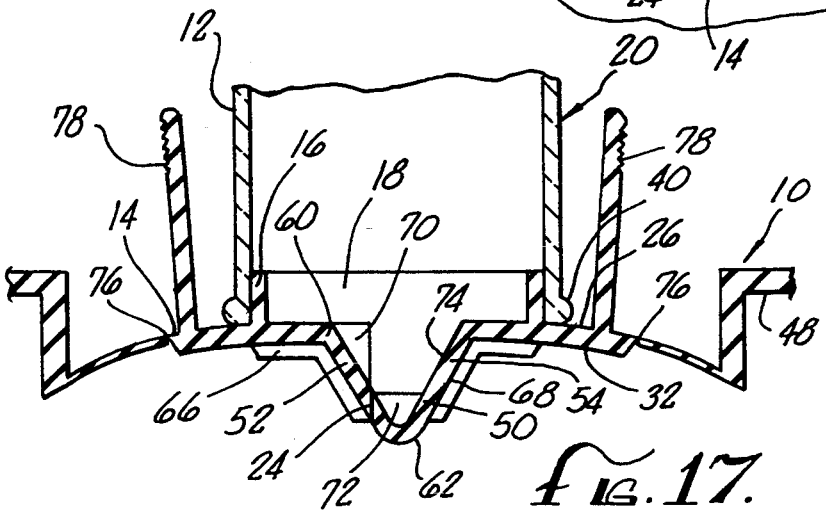
FIG. 17 is an enlarged cross sectional view of the central portion of the lid variant of FIG. 16 taken along line 17—17 of FIG. 16.

Several other features are incorporated in the version of FIGS. 13–17. The central portion of the lid 10 is bowed outward. This creates a closing force on the slit 24. A second feature is a thinning of the portion of the lid 10 surrounding the valve portion 14 to form a living hinge 76 around the valve portion 14. This helps keep the slit 24 closed until the valve slit 24 is purposely opened. The living hinge 76 assists in allowing flexing of the lid 10. FIGS. 16 and 17 show a still further variation of the lid 10, incorporating a pair of upright finger tabs 78 attached to the top surface 26 of the lid 10 inside the outer edge of the valve portion 24. Pressing the finger tabs 78 towards each other, either with or without flexing the lid, places opening force on the slit 24 in the valve 50.

After fluid, such as urine, is collected in the container 12, the lid 10 is placed on the open end of the container 12, the connection being liquid tight. To transfer the fluid to a specimen tube 20, the tube 20 is placed on to the connector 16 and the lidded container 12 is inverted. In order to allow fluid 22 in the container 12 to pass into the specimen tube 20, the specimen tube 20 is pushed toward the fluid 22 in the container 12 causing the lid 10 to flex inward and the slit 24 or hole 28 in the valve portion 14 to open as shown in FIGS. 5, 8, 19 and 21. In a like manner, flattening the curved lid of FIGS. 13–17 applies a stress to the slit 24 in the valve 50 causing the normally closed slit 24 to open.

A lid embodying features of the invention can be fabricated from a broad range of materials or combination of materials, the main requirement being that the central portion of the lid is made of a flexible material so that the valve portion can be moved downward toward the liquid in the container, causing the slit or hole to open. For example, the lid can be composed of synthetic or natural rubber, thermoplastic elastomers such as Krayton ®, or other flexible polymers such as polyethylene, polypropylene, or acetal homopolymers or copolymers. Alternatively, various parts of the lid can be made of different materials. For example, the skirt can be formed from a metal, such as aluminum, or molded from materials such as polypropylene, polycarbonate, nylon, or polysulfones, the lid can be a flexible material such as polyethylene or acetal copolymers and the valve portion can be a thermoplastic elastomer such as silicone or SBR rubber, all of the different materials being bonded together to produce an integral unit.

The lid 10 is designed to fit straight topped or threaded bottles used for collection of urine for urinalysis, these bottles commonly having diameters of approximately 2.5 inches. However, this is just a typical dimension. The invention contemplates lids 10 sized to fit a broad range of containers 12 from test tubes to buckets. Likewise, the connector 16 is designed to receive a test tube or centrifuge tube 20 which typically has a diameter of about 0.5 inches. However, the connector 16 can be sized to fit any dimension second container 20. It is also possible to have several connectors 16 on the lid 10 so that fluid 22 can be transferred to several specimen tubes 20 at one time. A typical lid 10 can have as few as one slit 24 or hole 28 or as many slits 24 and holes 28 as will fit within the connector and still remained sealed until physically opened. Typically the design of FIGS. 1–12 include from about four to about twelve slits or holes, preferably uniformly spaced from each other within the center of the connector. However, fewer or more slits or holes or a combination of slits and holes can be used. Also, the slits or holes may be perpendicular to the upper surface of the lid or at an angle to the plane of the lid surface, a typical angle for a slit being about 45°. Additionally, the components of the lid are not necessarily drawn to scale, some components being exaggerated in size for clarity.

Although the present invention has been described in considerable detail with reference to certain preferred versions and uses thereof, other versions and uses are possible. Also, while several different versions have been shown, each having different features, the invention contemplates using features of one version in the other versions. For example, the domed lid or finger tabs of FIGS. 13–17 may be adapted to the other versions. Additionally, because of the ability of the various valve configurations to seal against leakage, particularly the duck bill valve embodiment, the lidded container can be inverted without the specimen tube being attached to the connector. The specimen tube can then be added after the lidded container is inverted. Therefore, the spirit and scope of the appended claims should not be limited to the description of the preferred versions contained herein.

What is claimed is:

1. A flexible lid for placement on a container holding a liquid, said lid allowing transfer of the liquid from the container to a second container without leakage to the surrounding area wherein the lid comprises:

a means for leak proof attachment of a lid to first container, a valve portion located in the lid, the valve portion at least partially surrounded by a connector, the connector integral with the lid for attachment of a second container to the lid, said second container surrounding the valve portion, the connector being external of the first container, said valve portion having a normally closed port located in the lid within an area defined by the connector, the port openable without being pierced by an external member by attaching the second container to the connector and moving the attached second container toward the first container to flex an area surrounding the connector inwardly and place an opening stress on the port such that the port, when stressed to an open configuration, provides for fluid communication between a space within the first container and a space within the second container.

2. The lid of claim 1 wherein the normally closed port is a slit piercing the lid.

3. The lid of claim 1 wherein the normally closed port is a tapered hole at least partially piercing the lid, said hole connected to a slit at the smaller end of the taper, the combination of the hole and the slit fully piercing the lid.

4. The lid of claim 1 wherein the normally closed port is a valve depending from the center of the lid, the valve having a first and a second depending wall, the walls being joined at a point spaced from the lid, at least one slit piercing at least one of the walls.

5. In a valve for use in a lid of a container for holding a liquid, the valve preventing passage of the liquid therethrough until the valve is opened solely by application of a mechanical force to the lid of the container adjacent the valve, the mechanical force displacing the lid of the container toward the fluid in the container, the improved valve comprising a flexible center portion, at least one normally closed port located within the center portion, and a connector at least partially surrounding the flexible center portion, the port in an open position providing for fluid communication between a space within the container and a space exterior to the container, the port being convertible to its open position by application of the mechanical force to an area spaced from the port a distance greater than the location of the connector, the port returning to its normally closed condition upon removal of the force.

* * * * *